US007014389B1

(12) United States Patent
Siblik

(10) Patent No.: US 7,014,389 B1
(45) Date of Patent: Mar. 21, 2006

(54) ARTICULATED GUARDRAIL REFLECTOR ASSEMBLY

(75) Inventor: Allen D. Siblik, Wadsworth, IL (US)

(73) Assignee: Hallan Products, Ltd., Gurnee, IL (US)

( * ) Notice: Subject to any disclaimer, the term of this patent is extended or adjusted under 35 U.S.C. 154(b) by 0 days.

(21) Appl. No.: 10/769,667

(22) Filed: Jan. 30, 2004

(51) Int. Cl.
*E01F 9/017* (2006.01)

(52) U.S. Cl. ..... 404/10; 256/13.1; 116/63 P

(58) Field of Classification Search ..... 404/6, 404/9, 10; 256/1, 13.1; 116/63 R, 63 C, 116/63 P
See application file for complete search history.

(56) References Cited

U.S. PATENT DOCUMENTS

| | | | | | |
|---|---|---|---|---|---|
| 3,214,142 | A | | 10/1965 | Bown et al. | |
| 3,451,319 | A | * | 6/1969 | Gubela | 52/127.5 |
| 3,617,076 | A | * | 11/1971 | Attwood et al. | 403/395 |
| 4,000,882 | A | * | 1/1977 | Penton | 256/13.1 |
| 4,224,002 | A | * | 9/1980 | Heenan et al. | 404/9 |
| 4,249,832 | A | | 2/1981 | Schmanski | |
| 4,460,161 | A | * | 7/1984 | Grenga | 256/13.1 |
| 4,723,758 | A | * | 2/1988 | Gehrig | 256/13.1 |
| 5,678,950 | A | | 10/1997 | Junker | |
| D393,425 | S | * | 4/1998 | Weid | D10/111 |
| 5,788,405 | A | * | 8/1998 | Beard | 404/10 |
| 5,950,992 | A | * | 9/1999 | Weid | 256/13.1 |
| 6,036,399 | A | * | 3/2000 | Schalk | 404/6 |
| 6,220,576 | B1 | * | 4/2001 | Chan | 256/13.1 |
| 6,328,284 | B1 | * | 12/2001 | Wilding | 256/13.1 |
| 6,676,331 | B1 | * | 1/2004 | Casale | 404/6 |
| 2003/0085394 | A1 | * | 5/2003 | Ochoa | 256/13.1 |
| 2003/0091387 | A1 | * | 5/2003 | Brown et al. | 404/6 |

* cited by examiner

*Primary Examiner*—Thomas B. Will
*Assistant Examiner*—Alexandra Pechhold
(74) *Attorney, Agent, or Firm*—Patnaude & Videbeck

(57) ABSTRACT

An articulated guard rail reflector assembly includes a standardized base adapted for mounting the corrugations of a metal guardrail or on top of a guard rail and a pair of interchangeable top reflector holding members, one being circular in outline and one being trapezoidal in outline to fit in the corrugation of a metal highway barrier. The base member and the reflective member are joined by a spring steel L-shape clip that snaps into place. The base and reflector holding members may be made of sheet or galvanized metal, aluminum, polycarbonate plastic, ABS plastic or the like. The L-shape member is made of spring steel and allows the reflector to be moved backwardly of its direction facing traffic by either brushing forces rubbing against the guardrail, or by the pressure of packed snow being pushed against the guardrail by a motor vehicle carrying a snowplow or the like. Preferred reflector material includes plastic lenses and/or reflective tape.

14 Claims, 5 Drawing Sheets

ARTICULATED GUARDRAIL REFLECTOR ASSEMBLY

BACKGROUND OF THE INVENTION

This invention relates to highway and roadway reflectors and, more particularly, to reflectors mounted on corrugated metal barriers, roadway dividers and the like.

Roadway reflectors show motor vehicle drivers outlines of the highways or lanes in which they are driving during nighttime hours. They may be mounted in the concrete or macadam road surfaces between lanes or on the periphery thereof. They may also be mounted on metal posts on the side of the highways, on overhead signs, or on roadway barriers.

Metal or concrete roadway barriers or guardrails are vertically oriented and typically mounted immediately outwardly adjacent the highway shoulder to prevent vehicles from unintentionally leaving the highway or crossing medians in divided highways. As these barriers run generally parallel to the highway lanes, reflectors positioned on those barriers need to be positioned at right angles to the barriers to be seen by oncoming traffic.

U.S. Pat. No. 3,214,142 discloses reflector elements that may be mounted in the corrugations of metal highway barriers.

Larger reflectors that are set at 90 degree angles to concrete lane dividers are shown at U.S. Pat. Nos. 4,249,832 and 5,678,950. A more modern guard rail reflector that sits at 90 degrees to the guard rail to which it is mounted is shown at U.S. Pat. No. 5,950,992. This patent discloses two embodiments, one that sits on the top of I-beam guard rail supports and a second that fits in the corrugation of the metal guardrail.

U.S. Pat. No. 4,000,882, discloses a foam type reflector that is mounted in the corrugations of a steel roadway or Armco barrier. However, except for the small end of the panel, the reflective panel on these foam rubber inserts faces the roadway rather than oncoming drivers.

These reflective panels in most cases face an oncoming motor vehicle. In the case of reflectors positioned within the corrugation of steel roadway barriers, the existing reflective members are exposed to damage or breakage by the pressure of snow being forced against the barriers by snowplows during winter. Some of the patents disclose in writing supposedly resilient or elastic members, but do not show how that feature would act in the drawing. Even though a snowplow itself may not contact the roadway barrier or the reflector mounted in a corrugation or on top of the barrier (or on the side of a concrete barrier), the pressure of snow being forced to the side of the roadway by snowplows is enough to severely bend a metal based reflector or break a plastic based reflector of current construction. Resilience in the impact, as a vehicle rubs against a barrier, is also desirable.

A need has developed for a roadway reflector that is mountable on the top or side of a road barrier that will withstand the pressures and forces of snow being packed against it by a passing motor vehicle equipped with a snow plow.

It is therefore an object of the invention, generally stated, to provide a new and improved reflector for use in connection with highway road barriers.

Another object of the present invention is the provision of a highway road barrier mountable reflector that has the ability to resiliently withstand the forces of snow packed thereon by highway vehicles with snowplows attached thereto.

SUMMARY OF THE INVENTION

An articulated guard rail reflector assembly includes an elongate base suitable for mounting within at least one of the corrugation of a metal roadside barrier and the top and side of a roadside barrier, a reflector retaining member having reflective material mounted thereon and an L-shape spring steel member selectably releaseably retained at one end on said base and at an opposing end on said reflective retaining member.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENTS

Figure 1:
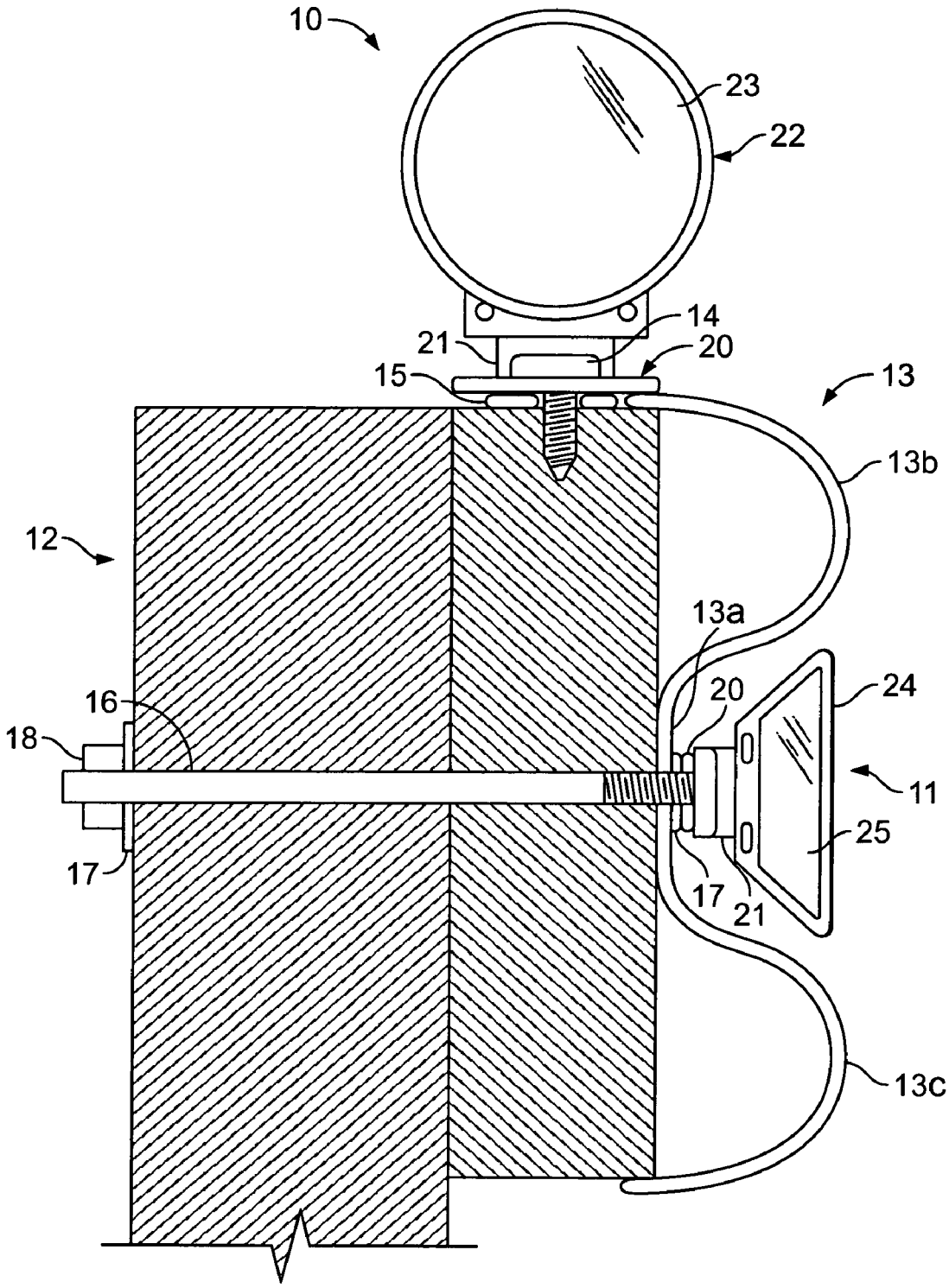
FIG. 1 is a cross-sectional view of a highway barrier post having a corrugated steel barrier mounted thereon and including circular and trapezoidal reflectors constructed in accordance with the present invention.
Figure 1A:
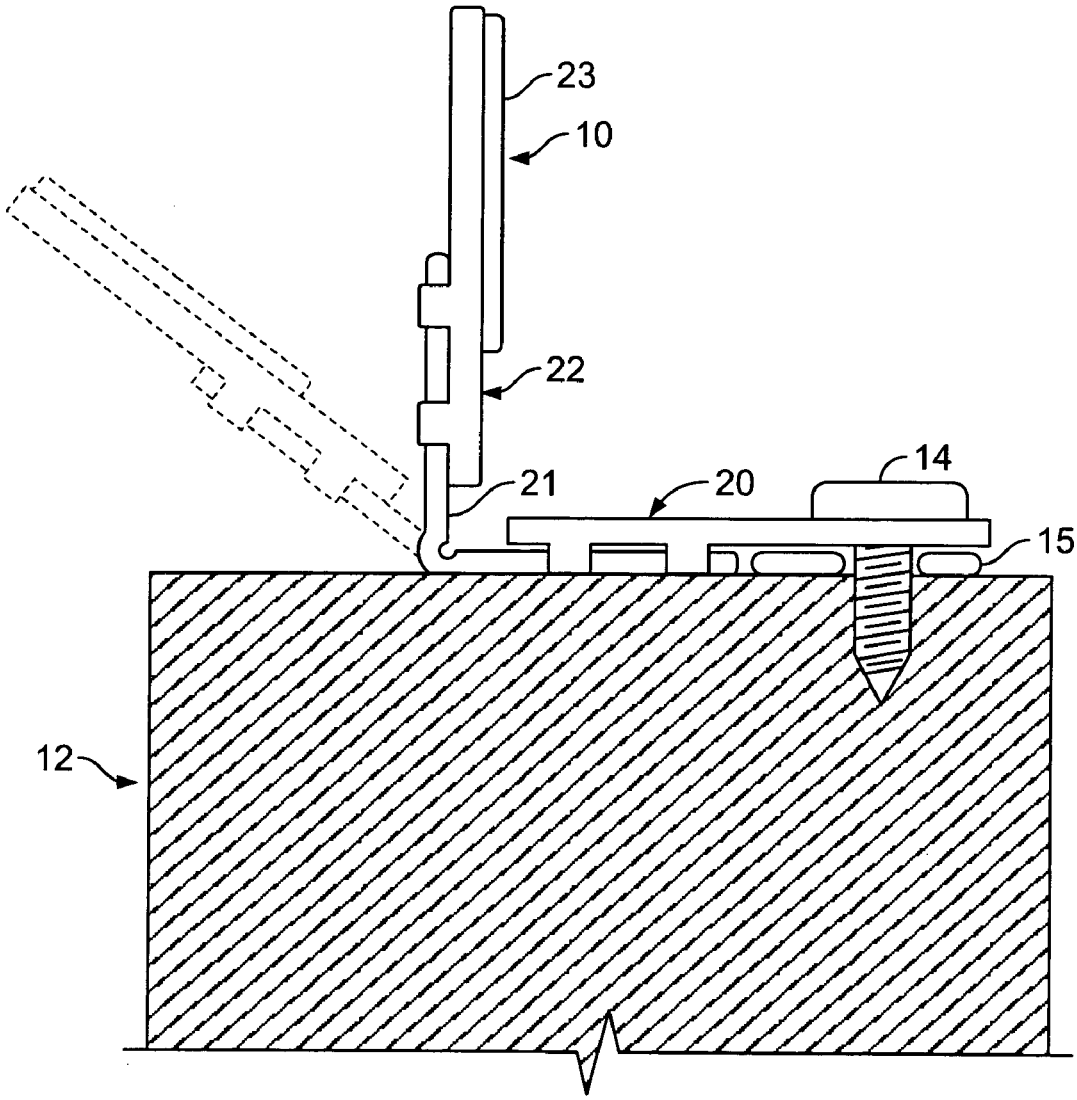
FIG. 1*a* is a fragmentary side view of the circular reflector shown at the top of FIG. 1 as it appears mounted on top of a barrier post (shown in cross-section)

Referring to FIGS. 1 and 1*a*, two embodiments of the articulated reflector of the present invention are shown at 10 and 11, respectively. Both reflectors 10 and 11 are metal framed and reflector 10 is circular in outline and adapted to be positioned on the top of a road barrier, generally indicated at 12, or a concrete lane divider (not shown). The trapezoidal shaped reflector, generally indicated at 11, is ideally suited for mounting on the flat portion 13*a* between the corrugations 13*b*, 13*c* of the metal road barrier, generally indicated at 13. In FIGS. 1 and 1*a*, the circular reflector, generally indicated at 10, is mounted to the top of the wood road barrier 12 by a wood screw 14 that has a washer 15 positioned on top of the wood road barrier 12. In FIG. 1, the trapezoidal shaped reflector 11 is mounted on flat portion 13*a* of the corrugated road barrier 13 by means of a through bolt 16 with washers 17—17 positioned at each end thereof and secured by a nut 18.

Referring to FIGS. 1 and 1*a*, the circular reflector, generally indicated at 10, includes a sheet or galvanized metal base 20 that is secured to the top of the wood road barrier 12 by wood screw 14. In an important aspect of the present invention, an L-shape spring steel member 21 is slidably mounted and retained at one end to the metal base member 20 and at its opposing end to the circular reflector mounting plate 22'. The circular reflective plate 23 mounted on mounting plate 22 may be made of reflective tape, plastic or the like. As shown most clearly in FIG. 1*a*, by the dotted line representation, spring steel L-shaped member 21 may be elastically bent to a substantial degree, most likely by forces asserted on the top plate 22 and reflector 23, and still spring back into a vertical position when the force is removed therefrom.

The trapezoidal metal reflector, generally indicated at 10, includes the identical base 20 of the circular reflector 10. Likewise, the identical L-shape spring steel member 21 is mounted at one end to the base 20 and at its other end to the trapezoidal reflector 24. The trapezoidal shape reflectors 25—25*a* may be made of reflective tape, plastic, or the like. Part of reflector 25 may be cut out, if necessary, to clear the L-shape members 57–60.

Figure 2:
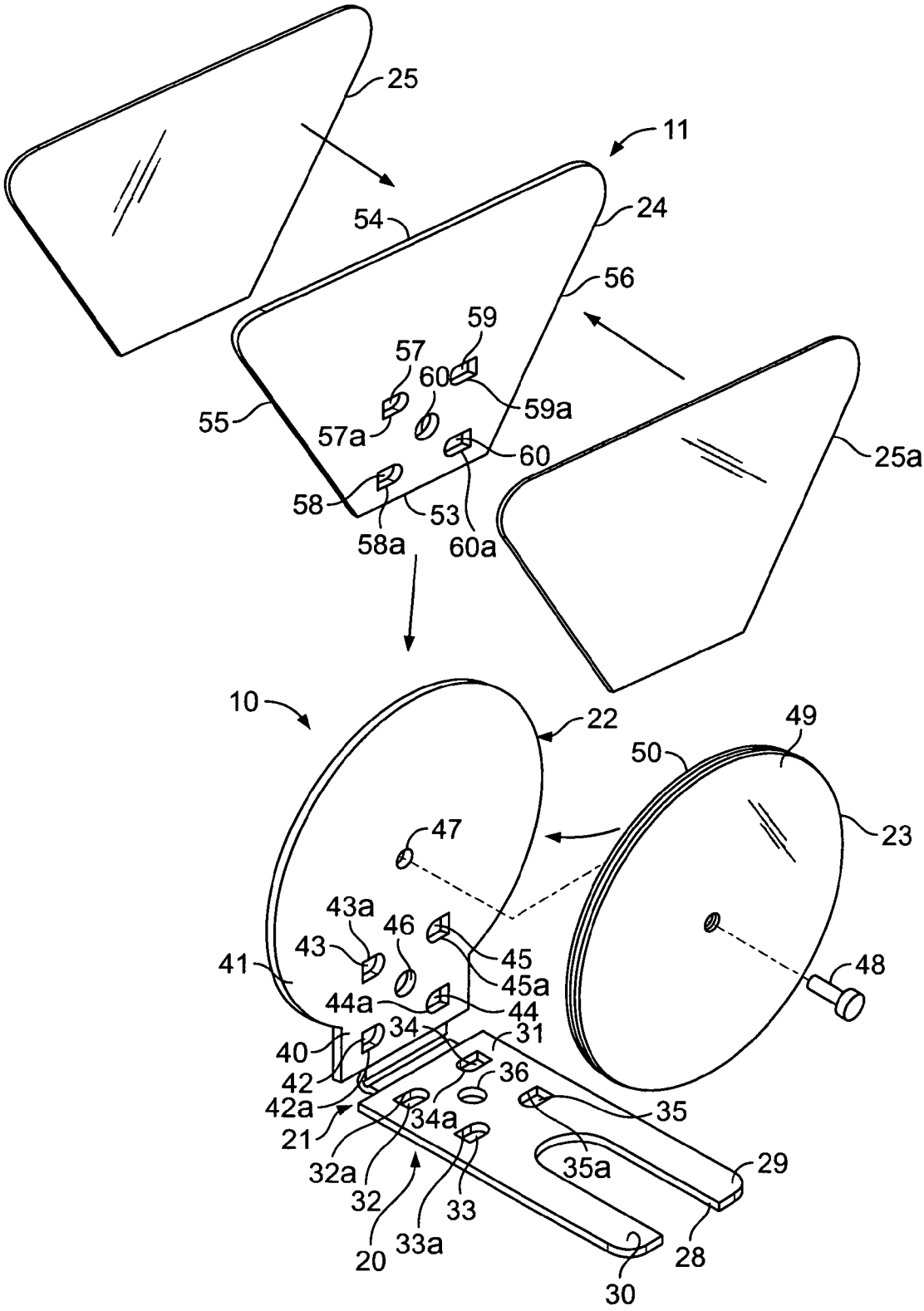
FIG. 2 is an exploded view of the reflectors of the present invention showing the construction of the circular and trapezoidal reflectors in metal.
Figure 6:
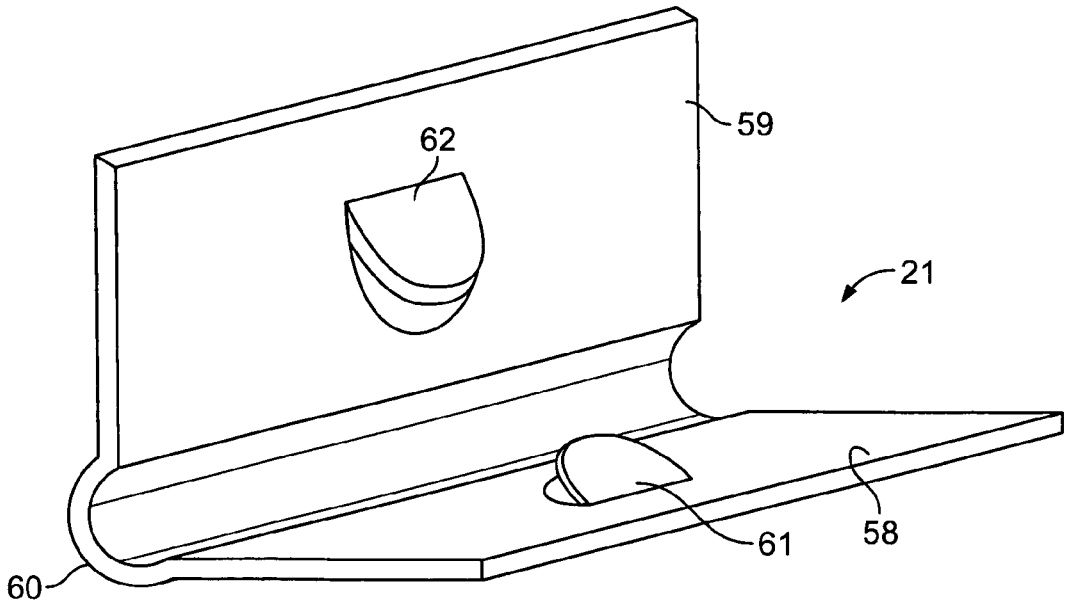
FIG. 6 is a perspective view of the L-shape spring steel member of the present invention.

Referring to FIGS. 2 and 6, both the round metal reflector, generally shown at 10, the trapezoidal shape reflector, generally shown at 11 share the same metal base, generally shown at 20 and the same L-shape spring steel member, generally shown at 21 that on one end thereof is mounted to the base 20 and on its opposing end is mounted to either the trapezoidal shape reflector 11 or the circular shape reflector 10.

Figure 5:
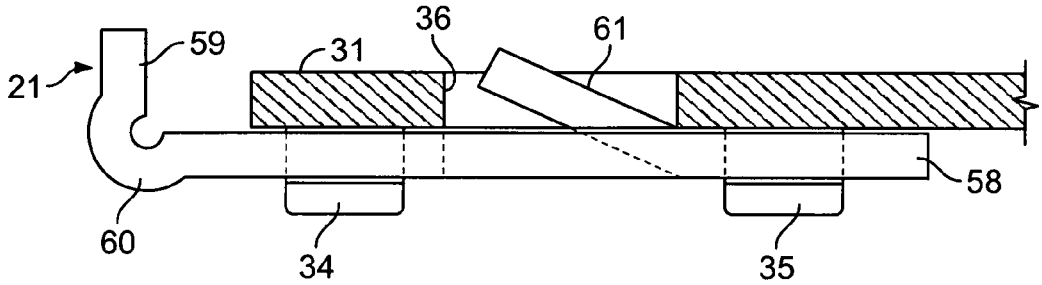
FIG. 5 is a fragmentary sectional view of the base member and L-shape spring member of the metal embodiment shown in FIG. 2.

Referring to FIGS. 2 and 5, the metal reflector base 20 starts out as a generally flat, generally rectangular metal stamping sheet measuring 3-¼×1-½×⅛ inch including a large slot 28 11/16×1-¾ inch extending inward and defining a pair of distal ends 29 and 30, sized to fit under and be retained by the head of a typical guardrail bolt, and an opposing rectangular mounting end 31 including a plurality, in this embodiment, four L-shape tabs 32, 33, 34, 35 approximately 3/16×5/16 that are displaced downwardly from the outward sides of the U-shape apertures 32*a*, 33*a*, 34*a*, 35*a* formed by the displacement of the respective tabs. Centrally of each of the four L-shape tabs 32–35, is a central circular aperture 36 5/16 inch in diameter that will be discussed in more detail below.

Referring to FIG. 2, the round metal reflector, generally indicated at 10, includes in this preferred embodiment, a rectangular bottom portion 40 1-½ inch across and a large circular top portion 41 3-¼ inches in diameter preferably made out of stamped sheet metal the same thickness as generally rectangular base member 20 with the rectangular bottom portion 40 being sized substantially similar to the rectangular mounting portion 31 of base member 20.

In a manner identical to that on the rectangular mounting end 31 of the slotted base member 20, the rectangular base end 40 of the circular metal reflector 22 includes a plurality, in this preferred embodiment four L-shape offsets 42–45 stamped into the rectangular mounting end 40 from the outsides thereof with the offset portions being attached to the circular metal reflector at the outsides of the apertures 42*a*–45*a* formed by the displacement of metal during the stamping of the L-shape tabs 41–45. The L-shape tabs 42–45 are identical to the tabs 34, 35 shown in FIG. 5. In the center of the four L-shape tabs 42–45, is a circular aperture 46 to be discussed in more detail below. Additionally, centrally of the circular portion 41 of base 22 is a second aperture 47 preferably threaded through which a threaded screw 48, or a rivet if desired, fixedly retains the circular reflective material 23 which, in this embodiment, includes a circular plastic lens 49, preferably of white or yellow color, retained in a circular metal frame 50.

Similarly to the mounting portion 31 of the base metal stamping and the mounting portion 40 of the round metal reflector 10, the trapezoidal reflector 11 includes a generally flat base side 53 1-½ inches long, and an elongate top side 54 5 inches long with opposed converging sides 55, 56, defining a 2-¾ inch high reflector preferably made of ⅛ inch stamped sheet metal. As with the reflector base 31 and the round reflector base 40, adjacent the base side 53 of trapezoidal reflector 11 is a plurality, in the preferred embodiment, four tabs stamped out of the sheet metal tabs 57, 58, 59 and 60, stamped out of the sheet metal to extend rearwardly of the reflector 11, also defining U-shape apertures 57*a*, 58*a*, 59*a* and 60*a*. These tabs are shaped and positioned identically to the metal tabs 42, 45 in the circular reflector 10 and tabs 32–35 in the reflector base, and are of a depth to retain the L-shape spring steel member therein. Also, a central aperture 61 is in the same position as the central apertures 46 and 36 of the reflector base and round reflector and performs the same function.

In this embodiment, a variation of the reflector is shown as having two adhesive panels 25 and 25*a* that are adhered to the front and back sides of the trapezoidal metal reflector.

Referring to FIGS. 5 and 6, one important aspect of the present invention is the spring steel L-shape member, generally indicated at 21 in FIG. 6. Generally L-shape member 21 is made of spring steel, starts out as a flat piece of sheet metal, approximately 1×2-½×1/32 inch, is bent into an L-shape defining base rectangular portion 58 about 1×1-3/16 inch, and vertical rectangular portion 59 about 1×3/16 inch joined by a semi-cylindrical rolled portion 60 ⅛ inch in inside diameter therebetween.

The inch width of L-shape spring steel member across the flat portions parallel to the axis of the rolled portion 60 is sized to fit snugly between the vertical portions of the various opposed L-shape members such as 32 and 34 in metal base member 20, 42 and 44 in upright round metal reflective member 22 and 58–60 in trapezoidal reflective member 24 i.e., the members define an opening about 1/32 inch in height. This allows the base member 58 to slide between the L-shape members 32–34 and 33–35 until such time as the tab 61, about 9/32×⅜ inch slips into and is retained by aperture 36 in the metal base member 20.

Likewise, the vertical tab 62 will be retained either in aperture 46 of the round metal reflector or aperture 60 of the trapezoid metal reflector when either of those reflectors is slidably mounted by its respective L-shape tabs on the vertical portion 59 of spring steel member 21. The central rolled portion 60 provides a structure to allow the vertical portion 59 to bend arcuately from its vertical portion to an obtuse angle when sufficient force is applied to the reflective member, such as by packed snow being moved by a highway snowplow, road grader or the like. The elasticity of the spring steel member allows the movement of the reflective member as shown in FIG. 1*a* in dotted line and allows that member to return to its original vertical position after the applied force has been removed therefrom.

Tabs 61 and 62 are not L-shaped similarly to the prior mentioned tabs, but are simply bent or creased at their bottom at an acute angle with the adjacent flat portion of the spring steel member.

Sliding the spring steel member along the L-shape tabs of the respective reflector mounting portion until the tab 61 or 62 enters and retains itself in the adjacent aperture 26, 46 or 60 will selectively lock the spring steel member to the respective reflective metal member. That locking engagement may be released by depressing the tab through the aperture until it elastically is positioned generally parallel to the remainder of the adjacent portion of the L-shape member from which it is springingly deformed, as shown most clearly in FIG. 5.

Figure 3:
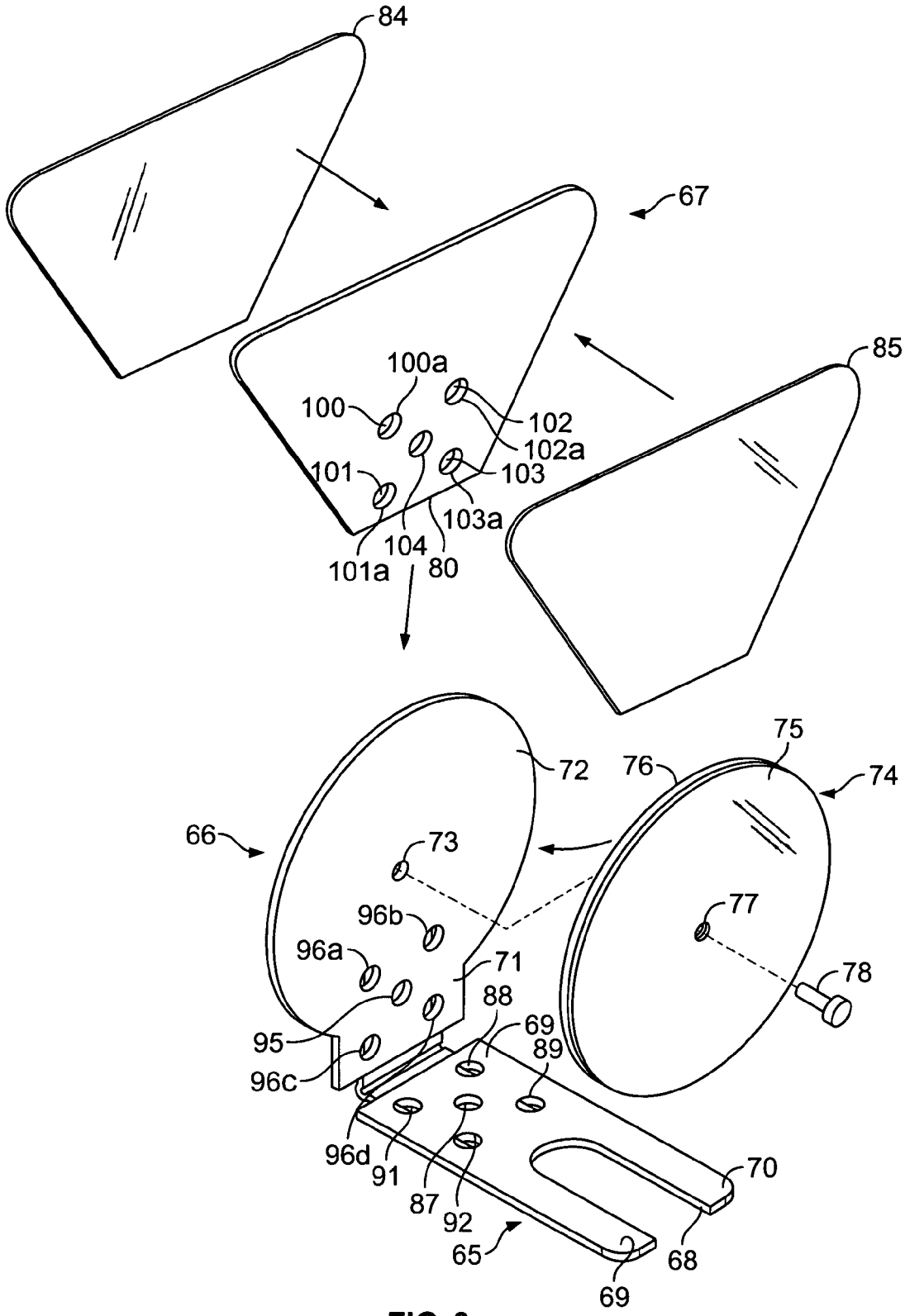
FIG. 3 is an exploded view of the trapezoidal and circular versions of the reflectors of the present invention shown as constructed in plastic.
Figure 4:
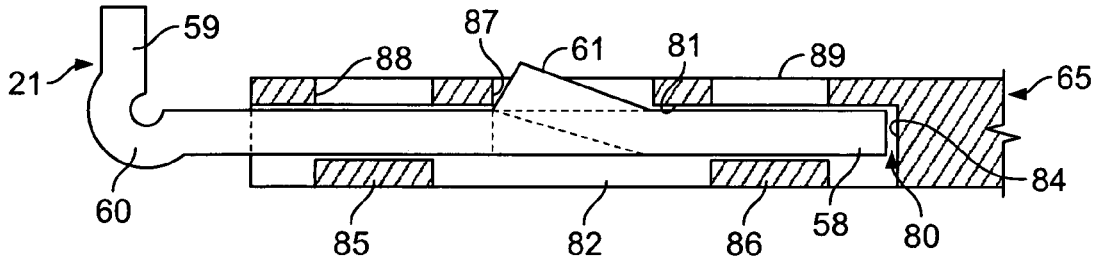
FIG. 4 is a fragmentary sectional view of the base and spring steel member of the plastic reflector shown in FIG. 3.

Referring to FIGS. 3 and 4, third and fourth embodiments of the articulated reflector of the present invention are shown with the reflector base 65, circular reflective material 66 and trapezoidal reflective material, generally indicated at 67 all made out of a tough plastic material such as polycarbonate, ABS, or the like. The outside dimensions of plastic reflector base 65 are sized substantially identical to those of metal reflective base 20 including an elongate slot 66 defining two distal end members 67, 68 and a rectangular mounting portion 69.

Similarly, circular reflective mounting plate 66 is sized on its outward dimensions identically to circular metal mounting plate 22 with respect to the size of the rectangular mounting portion 71 and circular reflector mounting portion 72, central threaded aperture 73 that allows the mounting of a reflector base 74 that includes a reflective lens element 75 mounted to a backing member 76 and includes a central aperture 77 through which a threaded screw 78, or rivet if desired retains the reflector lens 74 on the circular reflector mounting plate 66.

Likewise, the plastic trapezoidal reflector mounting plate 67 is sized identically on its outward dimensions to metal trapezoidal reflector plate 11 and includes a flat base mounting side 80. Trapezoidal reflector 67 includes, in this embodiment, reflective members 84, 85 that are substantially identical to reflective members 25, 25*a* and adhere to the front and back of trapezoidal plastic reflective member 67.

Referring to FIG. 4, the structure by which either of the opposing flat ends 58 or 59 of the L-shaped spring steel member 21 is mounted on and retained by the reflector base 65, and correspondingly in an identical manner to the plastic reflector mounting plate 66 and the trapezoidal reflector mounting plate 67, includes a cutout slot 80 that extends upwardly from the bottom surface of base member 65 in a generally rectangular shape defined by a top wall 81, side walls 82 and an opposing side wall (not shown) and an end wall 84. Slot 80 is approximately 1×1-¼×1/16 inch in size, with tolerances to allow the L-shape spring steel member to snugly slide therein.

While the plastic reflector base and circular and trapezoidal reflector mounting plates do not include L-shape tabs punched out of a metal plate like the metal reflector 10, the slot 80 does include four semicircular tabs 5/16×5-3/32×1/32, two of which are shown at 85 and 86 in FIG. 4 that extend inwardly of each of the opposing walls of the slot to slidingly engage and embrace the lower surface of either the rectangular base portion 58 or rectangular vertical portion 59 of the L-shape spring steel member 21. The bottom of base 20 is to fit flush against its mounting without the washers used on the metal embodiments. The flush fit aids the toughness of the tabs.

A central aperture 87 5/16 inch in diameter extend from the top wall 81 through the remainder of the plastic reflector base 65 provides an identical function as apertures 36, 46 and 60 of the metal reflector base and reflector mounting portions, respectively, in that it receives and restrainingly retains the spring steel mounting plate tab (61 as shown in FIG. 4).

In a manner identical to that shown in FIG. 5, the tab 61 may be bent downwardly until it is parallel to the remainder of the spring steel portion 58 when the reflector needs to be disassembled.

In the embodiment shown in FIG. 4, apertures 88 and 89 are formed above the respective tabs 85 and 86 and are sized similarly thereto to provide for ease of molding the tabs 85 and 86. In a manner similar to apertures 88 and 89 on one side of the plastic reflector base 65, apertures 91 and 92 are formed on the opposing side to allow for molding their complementary tabs (not shown) to extend inwardly adjacent the bottom of the slot 80 in base portion 65. In the preferred embodiment, tabs 85 and 86, and the remainder of the tabs in the base mounting plate 65 circular reflector mounting plate 66 and trapezoidal reflector mounting plate 67 are semicircular in shape, although it should be noted that other shapes such as rectangular, triangular or the like may be utilized in forming tabs to retain the spring steel, L-shape member on the respective reflector base and reflector mounting members.

The circular reflective mounting member 66 includes a central aperture 95 and apertures 96*a*, 96*b*, 96*c* and 96*d* positioned spatially adjacent corresponding semicircular tabs (not shown) because the vertical portion of the L-shape spring steel mounting member 59 covers same.

In a trapezoidal plastic reflector mounting member 67, tabs 100 and 101 are shown through apertures 10*a* and 101*a* respectively while the inward facing face of tabs 102 and 103 are shown through apertures 102*a* and 103*a*, respectively. Central aperture 104 again forms the same purpose in trapezoidal reflector mounting member as the central aperture 95 in the circular reflector mounting member.

Thus, two embodiments of a metal reflector are shown and described, and two embodiments of a plastic reflector are shown and described, disclosing features that provide the inventive aspects of the present disclosure.

All of these embodiments disclose articulated highway reflectors that will survive and continue to function after being deformed by pressure from snow, impact, or the like and will spring back to working position when that pressure or force has been released to provide for continued reflectivity, increased life of the reflector, and increased safety for travelers traveling on the roads adjacent which these reflectors are mounted.

While four embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. An articulated reflector for use on lane dividers and guardrails comprising:

a base including means for retaining said base on standard guardrail mounting bolts, a reflector mounting member including means for mounting reflective media thereon, a resilient L-shape spring steel member defining substantially identical mounting portions oriented about 90 degrees from each other and joined by a bight portion therebetween, and said reflector mounting member is releaseably mounted on said resilient steel spring member.

2. The articulated reflector as defined in claim 1 wherein, said base includes a slotted end defining parallel space distal portions and a spring steel mounting end, said spring steel mounting end including a recess expanding inwardly from said spring steel mounting end and from a portion of a flat surface on said base adjacent said spring steel mounting end, a plurality of tabs extending inwardly of said recess in opposed pairs from opposing sides of said recess for retaining one end of said spring steel member thereon.

3. The articulated reflector as defined in claim 2 wherein said recess on said base includes an aperture therethrough positioned substantially centrally of said plurality of tabs for retaining an offset tab therein.

4. The articulated reflector as defined in claim 1 wherein said reflector mounting member includes a reflector mounting end and a spring steel member mounting end, said spring steel mounting member end including a plurality of L-shape tabs extending from one side of said base in opposed aligned pairs for retaining one end of said spring steel member in the spaces between the distal ends of said L-shape tabs and a side of said base.

5. The articulated reflector as defined in claim 4 wherein said reflector mounting member includes an aperture through said reflector mounting end positioned substantially centrally of said plurality of L-shape tabs.

6. The articulated reflector as defined in claim 1 wherein, said reflector mounting member includes a reflector mounting end and a spring steel mounting member end, said spring steel mounting member end including a recess expanding inwardly from said spring steel mounting member end and from a portion of a flat surface on said base adjacent said spring steel mounting member end, a plurality of tabs extending inwardly of said recess in opposed pairs from opposing sides of said recess for retaining one end of said spring steel member thereon.

7. The articulated reflector as defined in claim 6 wherein said reflector mounting member includes an aperture through a wall of said recess positioned substantially centrally of said plurality of tabs.

8. The articulated reflector as defined in claim 1 wherein said resilient L-shape spring steel member includes, opposed rectangular mounting portions about 1 inch by 1 inch in size joined by a bight portion that defines a hollow semi-cylindrical shape.

9. The articulated reflector as defined in claim 8 wherein each of said opposed rectangular mounting portions include a substantially centrally positioned offset tab for selectably releaseably retaining said L-shape spring steel member on one of said base member and said reflector retaining member.

10. An articulated reflector for use on lane dividers and guardrails comprising:

a base including means for retaining said base on standard guardrail mounting bolts, a reflector mounting member including means for mounting reflective media thereon, a resilient L-shape spring steel member defining substantially identical mounting portions oriented about 90 degrees from each other and joined by a bight portion therebetween, and wherein said base includes a slotted end defining parallel spaced distal portions and a spring steel member mounting end, said spring steel mounting member end including a plurality of L-shape tabs extending from one side of said base in opposed aligned pairs for retaining one end of said spring steel member in the spaces between the distal ends of said L-shape tabs and a side of said base.

11. The articulated reflector as defined in claim 10 wherein said spring steel mounting member end of said base includes an aperture therethrough positioned centrally of said L-shape tabs for retaining an offset tab therein.

12. An articulated reflector for use on guardrails comprising:

a base including a slotted end defining parallel spaced distal portions and a spring steel member mounting end, a reflector mounting member including a reflector mounting end for mounting reflective media thereon and a spring steel member mounting end;

a resilient L-shape spring steel member includes opposed rectangular mounting portions about 1 inch by 1 inch in size joined by a web or bight portion defining a hollow semi-cylindrical shape.

13. The articulated reflector as defined in claim 12 wherein both said spring steel member mounting ends at least partly are shaped identically and include a plurality of L-shape tabs extending from one side of said base in opposed aligned pairs for retaining end of said spring steel member in the spaces between the distal ends of said L-shape tabs and a side of said base.

14. The articulated reflector as defined in claim 12 wherein both said spring steel member mounting ends at least partly are shaped identically and include a recess expanding inwardly from said steel spring mounting member end and from a portion of a flat surface on said base adjacent said spring steel mounting member end, and a plurality of tabs extending inwardly of said recess in opposed pairs from opposing sides of said recess for retaining one end of said spring steel member thereon.

* * * * *